US007166973B1

(12) United States Patent
Douglas et al.

(10) Patent No.: US 7,166,973 B1
(45) Date of Patent: Jan. 23, 2007

(54) USE OF INCOMPLETE ENERGY RECOVERY FOR THE ENERGY COMPRESSION OF LARGE ENERGY SPREAD CHARGED PARTICLE BEAMS

(75) Inventors: David R. Douglas, Newport News, VA (US); Stephen V. Benson, Yorktown, VA (US)

(73) Assignee: Jefferson Science Associates LLC, Newport News, VA (US)

( * ) Notice: Subject to any disclaimer, the term of this patent is extended or adjusted under 35 U.S.C. 154(b) by 4 days.

(21) Appl. No.: 11/225,619

(22) Filed: Sep. 13, 2005

(51) Int. Cl.
*H05H 9/00* (2006.01)

(52) U.S. Cl. ..... 315/500; 315/505

(58) Field of Classification Search ..... 315/500, 315/501, 505
See application file for complete search history.

(56) References Cited

U.S. PATENT DOCUMENTS 5,719,478 A * 2/1998 Washio et al. ..... 315/500
5,744,919 A * 4/1998 Mishin et al. ..... 315/505

* cited by examiner

*Primary Examiner*—David Vu

(57) ABSTRACT

A method of energy recovery for RF-base linear charged particle accelerators that allows energy recovery without large relative momentum spread of the particle beam involving first accelerating a waveform particle beam having a crest and a centroid with an injection energy $E_o$ with the centroid of the particle beam at a phase offset $f_o$ from the crest of the accelerating waveform to an energy $E_{full}$ and then recovering the beam energy centroid a phase $f_o$+Df relative to the crest of the waveform particle beam such that $$(E_{full}-E_o)(1+\cos(f_o+Df))>dE/2$$

wherein dE=the full energy spread, dE/2=the full energy half spread and Df=the wave form phase distance.

2 Claims, 3 Drawing Sheets

USE OF INCOMPLETE ENERGY RECOVERY FOR THE ENERGY COMPRESSION OF LARGE ENERGY SPREAD CHARGED PARTICLE BEAMS

The United States of America may have certain rights to this invention under Management and Operating Contract No. DE-AC05-84ER 40150 from the Department of Energy.

FIELD OF THE INVENTION

The present invention relates to energy recovery in linear accelerators and more particularly to more efficient methods for energy recovery in such devices.

BACKGROUND OF THE INVENTION

RF-based linear charged particle accelerators typically operate with beam pulses timed to coincide or nearly coincide with the crest of the accelerating waveform so as to utilize the full available RF gradient and maximize the output energy. As a result, energy recovering linear accelerators decelerate the beam at or near the trough of the RF waveform. This is normally done fully out of phase with the accelerated beam so that the RF power drawn by the acceleration process is fully replaced by RF power drawn from the recovered beam.

This process cannot always be implemented in the event that the beam energy spread enlarges during transport from acceleration to deceleration. If some process (such as extraction of power from the beam using a Free Electron Laser, the quantum excitation of the beam energy spread due to synchrotron radiation processes, the enlargement of the beam energy spread due to use of the beam in a charged particle beam cooling system, or any other process leading to coherent or incoherent growth in the beam energy spread) enlarges the beam energy spread before the start of energy recovery, the highest energy components of the beam energy spectrum can in fact instead reside at energies higher than the available decelerating gradients can recover. This is due to the proximity in time of the beam to the trough of the RF waveform. As a result, after energy recovery the beam will have an extremely large relative momentum spread with attendant operational difficulties (such as severe beam loss). This is schematically illustrated in FIG. 1 which denotes the prior art methodology of energy recovery and wherein Df (as defined below) equals 180°.

There thus exists a need for an energy recovery system for an efficient energy recovery system that does not concurrently impose an extremely large relative momentum spread with the attendant operational difficulties in RF-based linear charged particle accelerators.

OBJECT OF THE INVENTION

It is an object of the present invention to provide an energy method and recovery system for RF-based linear charged particle accelerators that does not impose an extremely and unacceptably large relative momentum spread on the particle beam after energy recovery occurs.

SUMMARY OF THE INVENTION

The present invention describes a method of energy recovery for RF-based linear charged particle accelerators that allows energy recovery without large relative momentum spread of the particle beam comprising:

A) An RF waveform accelerating a charged particle beam having a centroid with an injection energy $E_o$ with said centroid of the particle beam accelerated at a phase offset $f_o$ from the crest of the accelerating waveform to an energy $E_{full}$; and B) Recovery of the beam energy centroid at a phase $f_o$+Df relative to the crest of the waveform particle beam such that $$(E_{full}-E_o)(1+\cos(f_o+Df))>dE/2$$

wherein dE=the full energy spread, dE/2=the full energy half spread and Df=the wave form phase distance from the crest of RF waveform to the centroid of the recovered beam.

DETAILED DESCRIPTION

Figure 1:
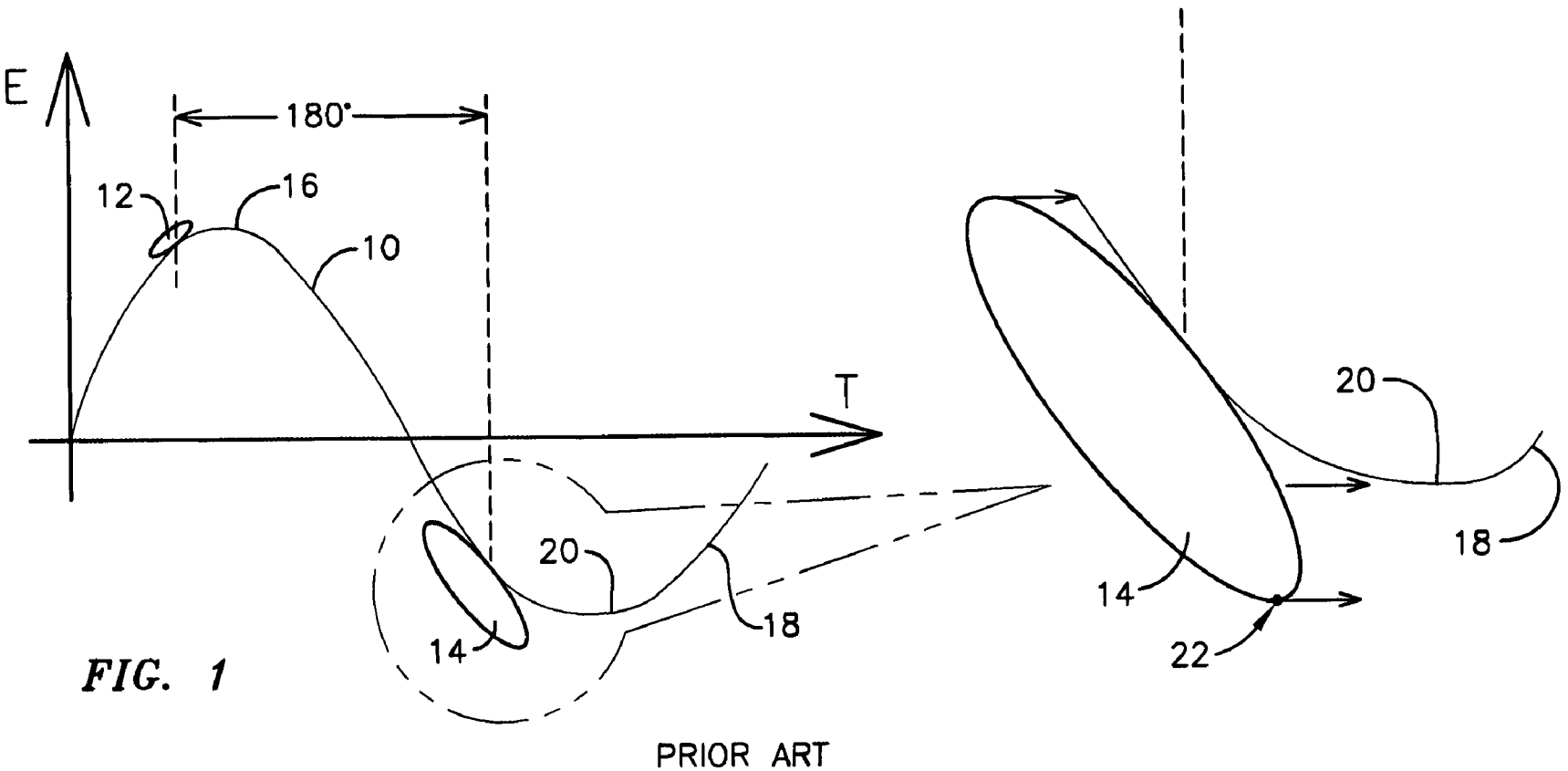
FIG. 1 is a schematic representation of energy vs. time for an accelerated beam bunch (near the crest of the RF waveform) and energy recovered bunch (near the trough) with enlarged momentum spread from, for example, the action of a free electron laser (FEL), or effect equivalent, but not limited to, other aforementioned processes operation in accordance with prior art methods.

It has now been determined that the extremely and unacceptably large relative momentum spread on the particle beam after energy recovery that occurs as described above, can be avoided through the use of "incomplete" energy recovery. In this method, the decelerated beam is not fully out of phase with the accelerated beam, so that the RF power drawn by acceleration is not entirely replaced by power drawn from the decelerated beam. Instead, the recovered beam energy centroid is decelerated farther out of trough than in the case of prior art complete energy recovery methods. Though this decrements the beam energy by a differential smaller than that provided by acceleration (so that the final beam energy is higher and not all the RF power is "replaced"), it allows the recovery of all the energy from the highest energy component of the decelerated beam. This is schematically illustrated in FIG. 2 wherein, E is the energy of a beam bunch (12, 14) during acceleration (12) or as it enters energy recovery (14) under the action of an RF waveform. The acceleration portion of the waveform is denoted 10, 16 represents the crest of the RF waveform, 18 refers to the decelerating portion of the waveform and 20 is its trough. The highest energy portion of the beam bunch as it enters energy recovery is, schematically, the extreme point 22. In the example graphically depicted in FIG. 1, Df is less than 180°.

Figure 2:
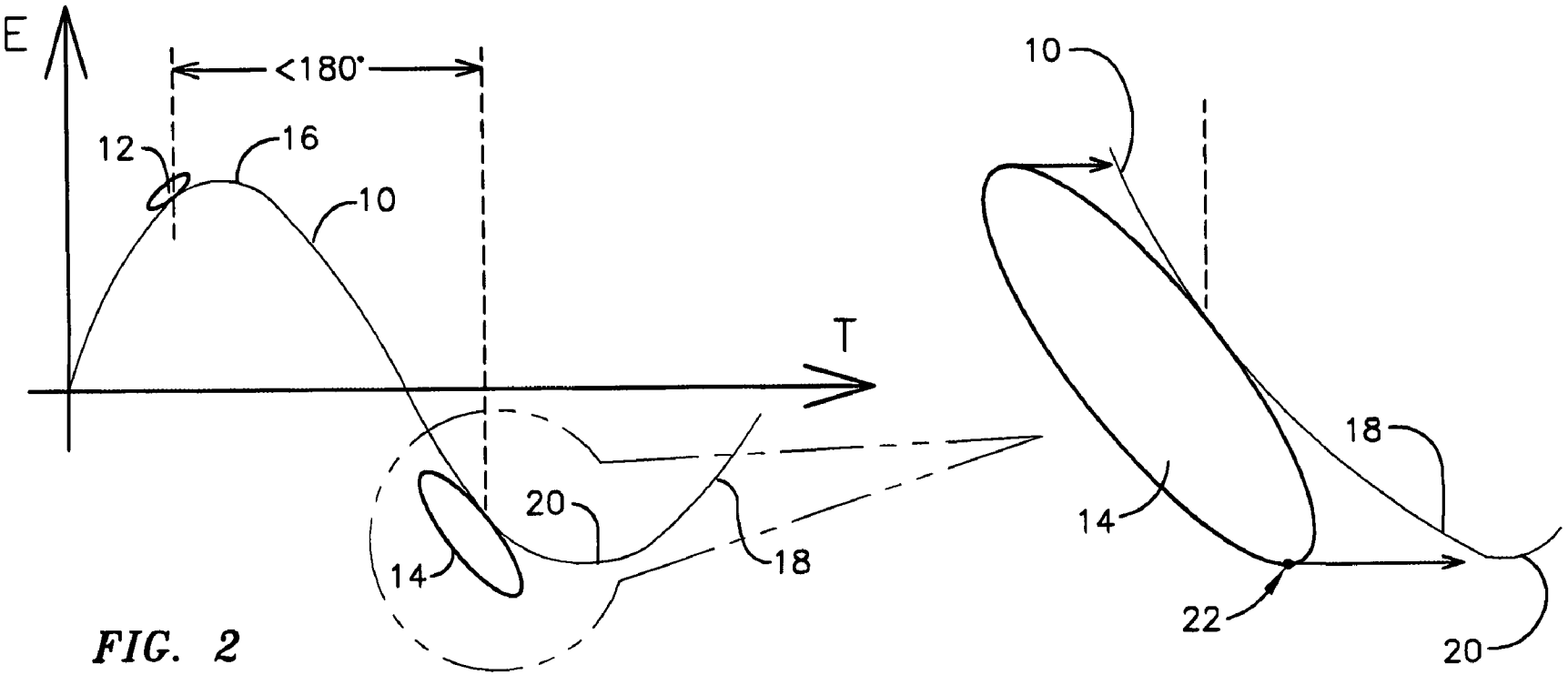
FIG. 2 is a schematic representation of energy vs. time for an accelerated beam bunch (near the crest of the RF waveform) and an incompletely recovered bunch train (near the trough, but not 180° out of phase from the accelerated bunch train).
Figure 3:
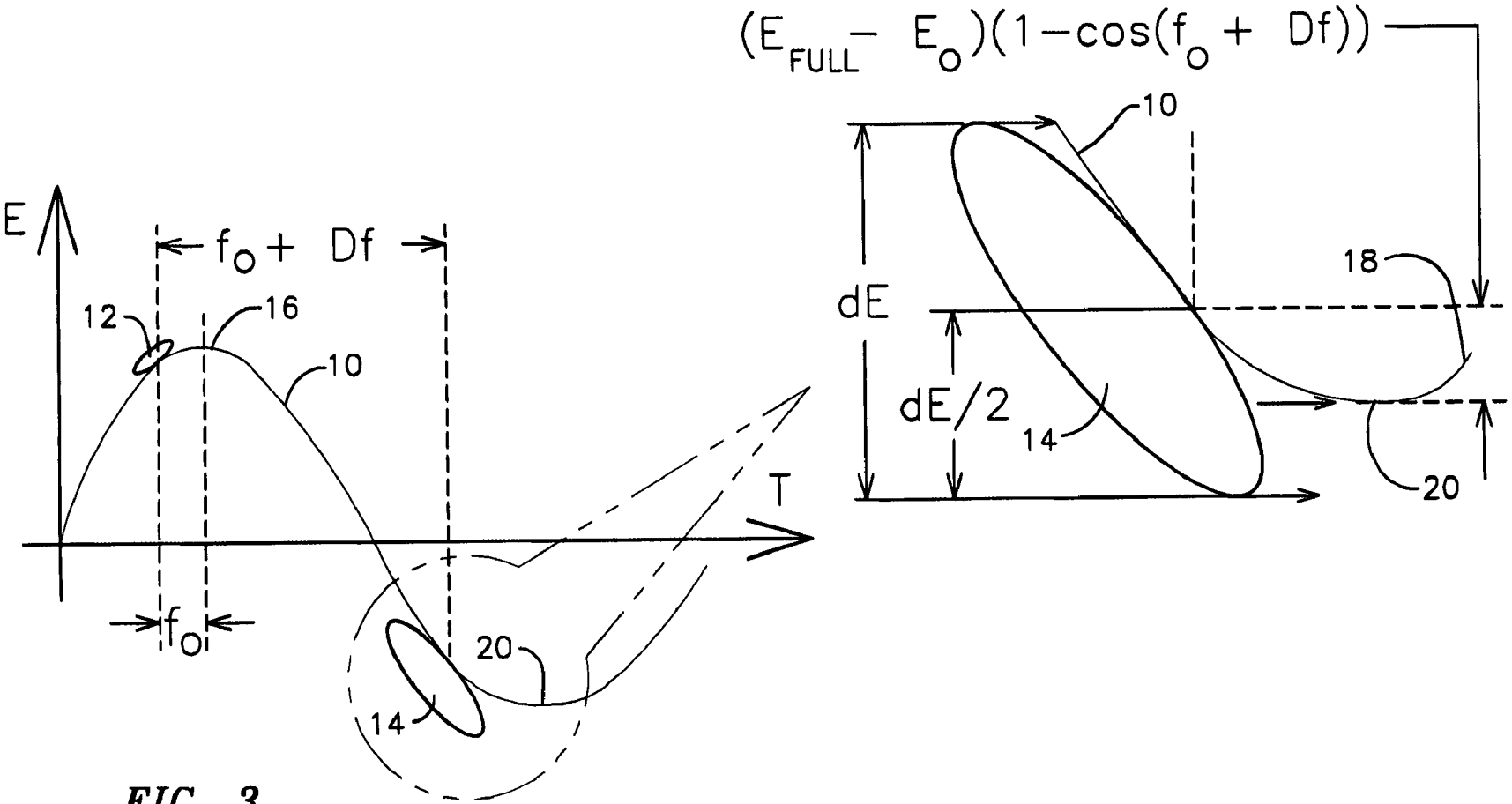
FIG. 3 is a schematic representation of detailed conditions of phase and energy spread for incomplete energy recovery in accordance with one illustrative example presented herein.

This process is not limited to a particular choice of phase. It depends only on moving the centroid of the decelerated beam away in phase from the trough of the RF waveform so that sufficient linac gradient is available to completely decelerate the highest energy component of the beam during energy recovery. The details of the method are better understood by by reference to FIG. 3 wherein is illustrated a system with injectin energy $E_0$ in which a beam bunch 10 with energy centroid 12 is accelerated with phase offset $f_0$ from crest 16 to an energy of $E_{full}$ and in which 14 represents the "spread configuration which is to be recovered with the beam energy centroid 18 at a phase offset ($f_o$+Df) relative to crest 16 of the waveform. In a completely energy recovered system, for example, Df=180° (see FIG. 1 that is representative of the prior art). In FIG. 3, we denote the in the "spread configuration" the beam full energy spread by dE. If the half-spread dE/2 exceeds the differential in linac energy between centroid energy 18 and trough 20, $$(E_{full}-E_o)(1+\cos(f_o+Df))>dE/2,$$

the condition of FIG. 1 holds and the energy-recovered beam will have a very large energy spread. If, however, Df is selected to ensure the energy centroid 18 of recovered beam 14 lies farther from trough 20 than this differential, i.e., such that $$(E_{full}-E_o)(1+\cos(f_o+Df))>dE/2,$$

then recovered beam 14 can be compressed in energy, beam 14 is more compact but subject to the requirement that the linac must provide the differential in RF power that is no longer supplied by the energy recovery process itself.

As an illustrative numerical example, consider a Free Electron Laser (FEL) driven by an energy recovering linac operated according to the following parameters.

| | |
|---|---|
| injection energy: | 10 MeV |
| full linac energy gain: | 90/cos 10° MeV |
| beam current: | 10 mA |
| FEL power: | 20 kW |
| full induced energy spread: | 10 MeV |
| accelerating phase: | 10° ahead of crest |

For the above parameters, the full beam energy will be 100 MeV (10 MeV injection +90 MeV gain from the linac when 10° off-crest). When lasing, the beam energy centroid will drop by 2 MeV (20 kW/10 mA, the sag driven by the extracted FEL power) to 98 MeV. As a consequence, the lowest energy in the beam will be around 93 MeV, and the highest energy in the beam will be 103 MeV (assuming, as is reasonable, the full energy spread is symmetrical about the centroid). If the beam is completely energy recovered—so that the acceleration power supplied by the linac is balanced by the power supplied by the beam during deceleration and the beam is decelerated exactly 180° out of phase from the accelerated beam—the beam centroid will be decelerated by 90 MeV from 98 MeV to 8 MeV. Noting that the linac can extract no more than 90/cos 10° MeV, or ~91.4 MeV from the beam (this being the maximum summed gradient), we see that the recovered beam will then have a component an energy of at least 103 MeV–91.4 MeV—or 11.6 meV. This is a very large exhaust energy spread.

If, however, the beam centroid is recovered 171° from the accelerated beam, or at a phase of 19° ahead of the trough, the energy centroid will be decelerated by (90/cos 10°)×cos 19° MeV, or 86.41 MeV, to an energy of 11.6 MeV. A proper choice of accelerator transport system phase/energy correlation (momentum compaction) can then be used to place the 103 MeV energy component coincident with the trough of the RF waveform—so that it will experience the maximum deceleration of 91.4 MeV and thus also will be decelerated to 11.6 MeV.

This method has been implemented in the Jefferson Lab IR Upgrade FEL driver and has been found in practice to be consistent with the above description.

In addition, we note that the utility of this method is made clear by a simple application of the conservation of energy. For example, consider an FEL driven by a energy recovered linac. A beam of current I is injected at an initial energy $E_o$ and accelerated to energy $E_{full}$ by the transfer of power $(E_{full}-E_o)I$ from the linac RF structure to the beam. Thereafter, power $P_{FEL}$ is extracted by the FEL. This corresponds (by the conservation of energy) to a shift in beam centroid energy of $DE=P_{FEL}/I$, and an increase in the beam momentum spread. If the enlarged energy spread is smaller than the available "underfoot" deceleration, the beam may be completely energy recovered—namely, the power $(E_{full}-E_o)I$ extracted by deceleration out of phase in the linac—completely restoring the power withdrawn from the linac by acceleration. Given, however, the centroid shift due to lasing (and the power extracted during lasing), the final beam energy and power are, respectively, $(E_o-DE)$ and $(E_o-DE)I$, less than the injected values. It is thus apparent that the lasing power comes from the injector. (This, for example, was the case in the Jefferson Lab IR Demo FEL.) In the case that the lasing-induced momentum spread exceeds the ability of the decelerating fields to recover all energies in the beam energy spectrum, we would instead use the method of incomplete energy recovery to avoid the generation of unmanageable energy spreads at the end of the energy recovery cycle. For example, if the FEL-induced momentum spread is not immoderately large (though in excess of the available underfoot deceleration), we may need only shift the phase of the energy recovered beam so as to recover a power $(E_{full}-E_o-DE)I$. In this case, the linear accelerator RF system would have to supply a total power of DE I to the beam during the acceleration/recovery process, and the beam would be decelerated to a final energy and power, respectively, of $E_o$ and $E_oI$—that is, the injected energy and power. In this case, the FEL power is provided entirely by the linac RF system, not the injector RF. If the FEL-induced momentum spread is yet larger, we would simply move the recovery phase farther from trough and decelerate the beam centroid energy to a value above that of the injection energy.

This discussion highlights an additional advantage of "incomplete" energy recovery in high power FEL systems. In very high power systems, the RF power draw devoted to driving the FEL becomes quite large. In complete energy recovered systems, this RF power is provided entirely from the injector, in which there are only a small number of RF cavities. The required power from each cavity thus becomes larger and RF power source and window difficulties are exacerbated. Use of incomplete energy recovery distributes the FEL related RF power draw across the larger collection of linac cavities. The beam may thus, at least in principle, be injected at lower energy and—with the FEL power draw distributed across the linac cavities—the magnitude of RF power demands on each individual component and the RF power loading on each cavity's window(s) are reduced.

In summary, the method of incomplete energy recovery has at least the following novel capabilities absent from traditional energy recovery systems and methods:

1. it allows energy recovery with energy compression of larger energy spreads than is possible using complete energy recovery, allowing operation of higher extraction efficiency FELs 2. it distributes the RF power draw driving the FEL across the linac (many RF cavities), alleviating injector RF power source and window demands and thereby easing operational demands on systems driving very high power FELs.

As the invention has been described, it will be apparent to those skilled in the art that the same may be varied in many ways without departing from the intended spirit and scope of the invention, and any and all such modifications are intended to be included within the scope of the appended claims.

What is claimed is:

1. A method of energy recovery for RF-base linear charged particle accelerators that allows energy recovery without large relative momentum spread of the particle beam comprising:

C) accelerating a waveform particle beam having a crest and a centroid with an injection energy $E_o$ with the centroid of the particle beam at a phase offset $f_o$ from the crest of the accelerating waveform to an energy $E_{fidl}$; and D) recovering the beam energy centroid a phase $f_o$+Df relative to the crest of the waveform particle beam such that $$(E_{fidl}-E_o)(1+\cos(f_o+Df))>dE/2$$

wherein dE=the full energy spread, dE/2=the full energy half spread and Df=the wave form phase distance.

2. A free electron laser driven by an energy recovered linac wherein energy recovery is accomplished by:

A) accelerating a waveform laser beam having a crest and a centroid with an injection energy $E_o$ with the centroid of the laser beam at a phase offset $f_o$ from the crest of the accelerating waveform to an energy $E_{fidl}$; and B) recovering the beam energy centroid a phase $f_o$+Df relative to the crest of the waveform laser beam such that $$(E_{fidl}-E_o)(1+\cos(f_o+Df))>dE/2$$

wherein dE=the full energy spread, dE/2=the full energy half spread and Df=the wave form phase distance.

* * * * *